United States Patent [19]

Dessauer et al.

[11] 4,247,618

[45] Jan. 27, 1981

[54] PHOTOIMAGING SYSTEMS WITH CYCLIC HYDRAZIDES

[75] Inventors: Rolf Dessauer, Greenville; Raymond A. Firmani, Wilmington, both of Del.

[73] Assignee: E. I. Du Pont de Nemours and Company, Wilmington, Del.

[21] Appl. No.: 38,056

[22] Filed: May 11, 1979

[51] Int. Cl.[2] ..... G03C 1/00; G03C 1/52

[52] U.S. Cl. ..... 430/342; 430/338

[58] Field of Search ..... 96/48, 90 R, 88, 107; 430/332, 339, 343, 338, 342, 340

[56] References Cited

U.S. PATENT DOCUMENTS

| | | | |
|---|---|---|---|
| 2,289,367 | 7/1942 | Kendall | 96/66 R |
| 2,728,115 | 4/1973 | Poot et al. | 96/29 D |
| 3,445,234 | 5/1969 | Cescon et al. | 96/90 R |
| 3,552,973 | 1/1971 | Fishman | 96/48 R |
| 3,585,038 | 6/1971 | Cescon et al. | 96/90 R |
| 3,753,395 | 8/1973 | Poot et al. | 96/28 |
| 3,778,267 | 12/1973 | Braunstein | 96/66 R X |
| 3,926,643 | 12/1975 | Chang | 96/115 P |
| 4,028,108 | 6/1977 | Van Royen | 96/90 PC X |

OTHER PUBLICATIONS

Jaromir Kosar; Light Sensitive Systems, 1966 p. 361.

George H. Richter, Textbook of Organic Chemistry, p. 481—John Wiley & Sons, N.Y. 1952.

*Primary Examiner*—Edward C. Kimlin

*Assistant Examiner*—Alfonso T. Suro Pico

[57] ABSTRACT

A photosensitive system comprising in intimate admixture (1) a dye in its leuco form, (2) a photooxidant taken from the group of hexaarylbiimidazole compounds, benzophenone, para-aminophenyl ketones, polynuclear quinones and thioxanthenones, and mixtures thereof and in the presence of the admixture is a 5-member-heterocyclic phenylhydrazide compound. The cyclic phenylhydrazide can be present in the admixture, or a dry coating of the admixture, after imagewise exposure, is treated with a solution of the heterocyclic compound. The system is useful in formation of colored images.

19 Claims, No Drawings

PHOTOIMAGING SYSTEMS WITH CYCLIC HYDRAZIDES

DESCRIPTION

TECHNICAL FIELD

This invention relates to new photosensitive systems. More particularly this invention relates to leuco dye/-photooxidant photosensitive systems in the presence of cyclic phenylhydrazides.

BACKGROUND ART

Photosensitive compositions, e.g., hexaarylbiimidazole/leuco compositions have been found to be of use in photographic applications because of their ability to form permanent colored images rapidly upon exposure to electromagnetic-irradiation, particularly in the ultraviolet region. However, since they are also sensitive to visible light and form color upon exposure to such light, it is difficult to prevent color formation in such compositions upon exposure to ambient room light, sunlight, or daylight, and thus it is difficult to handle the compositions.

In order to retain an image once it has been formed, color development in the unilluminated portions of the image pattern by exposure to ultraviolet radiation must be avoided. It is known to preserve the original image by applying to the imaged material, e.g., by spraying or immersion, a solution of hydroquinone. While this is advantageous in preserving or fixing the original image, more effective agents are desirable, i.e., those which have a rapid deactivation effect coupled with excellent ambient light stability.

It is also desirous that leuco dye/photooxidant compositions coated on suitable supports possess sufficient dark stability to permit coatings to be useful for extended periods of time, that the coated products can be handled for limited periods of time in ambient light environments without change, both prior to, and subsequent to the imaging exposure, that they have good dot rendition, and that the coated products can be made permanently stable when this is desirable.

DISCLOSURE OF THE INVENTION

In accordance with this invention there is provided a photosensitive system comprising in intimate admixture (1) at least one dye in the leuco form having one to two removable hydrogens, the removal of which forms a differently colored compound; with the proviso that when the leuco form has only one removable hydrogen and the resultant dye is cationic, there is also present a mineral acid, organic acid or acid-supplying compound which forms a salt with the leuco form of the dye, and (2) at least one photooxidant compound taken from the group of a 2,4,5-triarylimidazolyl dimer consisting of two lophine radicals bound together by a single covalent bond, benzophenone, a para-aminophenyl ketone, a polynuclear quinone, a thioxanthenone, and mixtures thereof, the improvement being that in the presence of the said admixture is at least one heterocyclic compound of the formula:

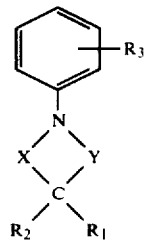

wherein X may be either $H_2C<$ or $O{=}C<$ with the proviso that when X is $H_2C<$, Y is

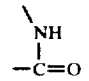

and when X is $O{=}C<$, Y is

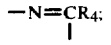

$R_1$ and $R_2$ are the same or different and are hydrogen atoms, alkyl of 1 to 4 carbon atoms, hydroxyalkyl of 1 to 4 carbons atoms, and $R_3$ is hydrogen, alkyl of 1 to 4 carbon atoms in the ortho, meta or para positions, alkoxy of 1 to 4 carbon atoms in the ortho, meta, or para positions, chloro, fluoro or bromo in the meta or para positions, sulfo in the para position, substituted alkyl, aralkoxy, and aryloxy; $R_4$ is hydrogen and alkyl of 1 to 4 carbon atoms.

The photosensitive system of the invention comprises an admixture of (1) a dye in its leuco form and (2) a photooxidant compound as described above. The 5-member-heterocyclic phenylhydrazide as described above is utilized in the presence of the admixture as is more fully described below.

The leuco form of the dye useful in the invention comprises a dye in reduced form having one or two hydrogen atoms, the removal of which together with an additional electron in certain cases produces the dye. Since the leuco form of the dye is substantially colorless, or in some instances it may be of a different color or of a less intense shade than the parent dye, it provides a means of producing a pattern when the leuco form is oxidized to the dye. This oxidation is accomplished in the invention by having present, in intimate admixture with the leuco form of the dye, a photooxidant which is either a hexaarylbiimidazole compound, benzophenone, a p-aminophenyl ketone, a polynuclear quinone, a thioxanthenone, or a mixture of two or more photooxidants, e.g., benzophenone and a p-aminophenyl ketone. The photooxidant is activated by light in the ultraviolet range of wavelength from about 2000 Å to about 4200 Å, and when irradiated with light within this range it splits into free imidazolyl or other radicals. These free radicals react with the leuco form of the dye to produce a colored image against a background of unirradiated and, therefore, unchanged material.

Useful types of dyes in the leuco form which can be readily converted to the parent dye by free radicals by the above-described mechanism preferably include:

(a) aminotriarylmethanes (b) aminohydrocinnamic acids (cyanoethanes, leuco methines)

(c) benzylhydroxyindanone, etc.

Other useful leuco dyes are disclosed in U.S. Pat. No. 3,552,973, columns 6 to 11. Specific examples of leuco dyes which lose one hydrogen atom belong to type (a) while the leuco dyes which lose two hydrogen atoms belong to type (b).

Particularly preferred are the aminotriarylmethanes, e.g., acid salts of aminotriarylmethanes wherein at least two of the aryl groups are phenyl groups having (a) an $R_5R_6N$-substituent in the position para to the bond to the methane carbon atom wherein $R_5$ and $R_6$ are each groups selected from hydrogen, $C_1$ to $C_{10}$ alkyl, 2-hydroxyethyl, 2-cyano-ethyl, or benzyl and (b) a group ortho to the methane carbon atom which is selected from lower alkyl, lower alkoxy, fluorine, chlorine or bromine; and the third aryl group may be the same as or different from the first two, and when different is selected from (a) phenyl which can be substituted with lower alkyl, lower alkoxy, chloro, diphenylamino, cyano, nitro, hydroxy, fluoro or bromo;

(b) naphthyl which can be substituted with amino, di-lower alkylamino, alkylamino;

(c) pyridyl which can be substituted with alkyl;

(d) quinolyl;

(e) indolinylidene which can be substituted with alkyl.

Preferably, $R_5$ and $R_6$ are hydrogen or alkyl of 1–4 carbon atoms. Most preferably all three aryl groups are the same.

The triarylmethanes of the structure of the preceding paragraph do not undergo a color-forming reaction under ordinary darkroom storage conditions and are therefore preferred. Other aminotriarylmethanes employed in the compositions of this invention do undergo a color-forming dark reaction which leads to fogging or coloration of photographic films, papers or other systems containing the light-sensitive compositions of this invention. However, such aminotriarylmethanes are operable in the novel compositions, for the color-forming dark reaction can be prevented by storing such compositions in the absence of air.

Representative aminotriarylmethanes and aminohydrocinnamic acids are found in U.S. Pat. No. 3,552,973, column 6, line 50 to column 7, line 50 and column 9, lines 1 to 26, respectively.

The photooxidant component of the admixture can be one or more of the following types of compounds.

The hexaarylbiimidazoles are represented by the formula:

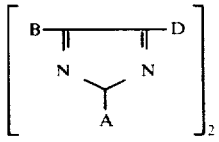

wherein A, B and D represent aryl groups which can be the same or different carbocyclic or heterocyclic unsubstituted or substituted with substituents that do not interfere with the disassociation of the biimidazole to the imidazolyl radical or with the oxidation of the leuco dye. Upon disassociation, the dimer forms the corresponding 2,4,5-triarylimidazolyl radical. The B and D groups can normally carry 0–3 substituents, the A group, 0–4 substituents. Useful hexaarylbiimidazole compounds and their preparation are disclosed in U.S. Pat. No. 3,552,973 column 4, line 22 to column 6, line 3.

Para-aminophenyl ketones which can be used separately or preferably in combination with benzophenone may be represented by the formula:

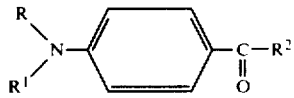

wherein R and $R^1$ are each hydrogen or alkyl, preferably lower alkyl; and $R^2$ is alkyl, preferably lower alkyl, monocarbocyclic aryl, preferably phenyl, or an

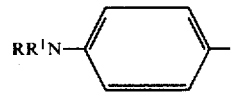

group. By the term "lower" as expressed in this invention is meant that the alkyl group contains 1–4 carbons.

Useful polynuclear quinones have two intracyclic carbonyl groups attached to intracyclic carbon atoms in a conjugated six-membered ring, there being at least one aromatic carbocyclic ring fused to the ring containing the carbonyl groups. U.S. Pat. No. 2,951,758 discloses useful polynuclear quinones. Specific examples include: 9,10-anthraquinone, 1-chloroanthraquinone, 2-chloroanthraquinone, 2-methylanthraquinone, 2-tert-butylanthraquinone, octamethylanthraquinone, 1,4-napthaoquinone, 9,10-phenanthrenequinone, 1,2-benzanthraquinone, 2,3-benzanthraquinone, 2-methyl-1,4-napththoquinone, 2,3-dichloronaphthoquinone, 1,4-dimethylanthraquinone, 2,3-dimethylanthraquinone, 2-phenylanthraquinone, 2,3-diphenylanthraquinone, sodium salt of anthraquinone alpha-sulfonic acid, 3-chloro-2-methylanthraquinone, retenequinone, 7,8,9,10-tetrahydronaphthacenequinone, 1,2,3,4-tetrahydrobenz[a]anthracene-7,12-dione.

Thioxanthenones also useful as a photooxidant compound have the general formula:

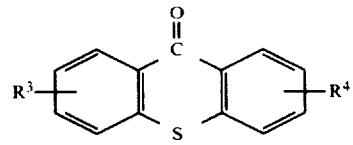

wherein $R^3$ and $R^4$ can be H, alkyl, e.g., 1 to 4 carbon atoms, alkoxy, e.g., 1 to 4 carbon atoms, dialkylamino, halogen, e.g., chlorine, bromine, fluorene, etc. Useful thioxanthenones are disclosed in U.S. Pat. No. 3,926,643.

The cyclic phenylhydrazides useful in the presence of the admixture of the photosensitive system are represented by the formula set forth above. The useful compounds can be substituted in the 4-position of the heterocyclic ring or in the phenyl radical as indicated. It is necessary that the compounds be soluble in the system to the largest extent possible. Therefore, it is apparent that not all the substituted compounds will provide identical results. Preferred cyclic phenylhydrazides include:

1-phenylpyrazolidine-3-one (Phenidone A, represented by formula (1) below), 1-phenyl-4-methylpyrazolidine-3-one (Phenidone B, represented by formula (2) below), and 1-phenyl-4,4-dimethylpyrazolidine-3-one (Dimezone, represented by formula (3)) below).

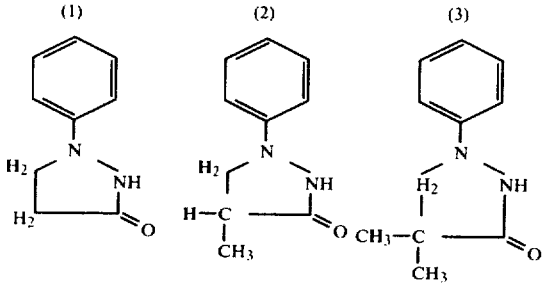

Also preferred are 3-methyl-1-(p-sulfophenyl)-2-pyrazoline-5-one and 3-methyl-1-phenyl-2-pyrazoline-5-one.

The following substituents can be present on the phenyl radical of the cyclic phenylhydrazides:

ortho, meta, para-methyl
para-trifluoromethyl
meta, para-chloro
meta, para-bromo
para-fluoro
ortho, meta, para-methoxy
para-ethoxy
para-benzyloxy
para-butoxy
para-phenoxy
2,4,6-trimethyl
3,4-dimethyl.

The following substituents can be present on the 4-position of the heterocyclic radical of the cyclic phenylhydrazides:

bis-hydroxymethyl
hydroxymethyl and methyl
hydroxymethyl
dimethyl
dibutyl
ethyl
benzyl.

The following substituents can be present on the 5-position of the heterocyclic radical of the cyclic phenylhydrazides:

dimethyl
methyl
phenyl.

Since the presence of the cyclic phenylhydrazides has a tendency to reduce the photospeed of the photosensitive system, these compounds are used in amounts of up to 10 mole percent based on the photooxidant component (2). An effective range is 0.1 to 10 mole percent. Preferably as small a quantity as possible of the compound should be used to get the desired result. The color hue of the formed image is not affected by the amount of cyclic phenylhydrazide present.

The cyclic phenylhydrazide can be present in the admixture of the leuco dye and photooxidant compound or when said admixture is in the form of a dry coating or layer, after imagewise exposure thereof, the dry coating or layer can be treated by dipping or applying thereto a solution containing the heterocyclic compound. The solution containing the heterocyclic compound generally also contains additives such as sodium sulfite, acids, e.g., acetic acid, etc. in amounts up to about 2.0% by weight. Suitable solvents include: water, alcohol, e.g., methanol, ethanol, propanol, etc. It is essential for effective color fixing that the cyclic phenylhydrazides be adequately soluble in the solvent solution and are sufficiently absorbed into the photosensitive coating as the result of the immersion or other type treatment.

The leuco form of the dye and the photooxidant, e.g., hexaarylbiimidazole, etc. are mixed in mole ratios within the range of about 10:1 (leuco dye:photooxidant) to about 1:10. In the presence of a small quantity of solvent, including moisture, such mixtures will produce on substrates a permanent image when irradiated with ultraviolet light. The preferred ratio range is 2:1 to 1:2, while the preferred ratio is about 1:1.

The operation principle of the photosensitive system comprising a leuco dye and hexaarylbiimidazole compound is known. For example, U.S. Pat. No. 3,445,234 discloses the operation as well as additional information relative to the primary and additional components of such a photosensitive system. Information relative to additional components is set forth below. It is not believed that the presence of a different photooxidant compound changes the operation.

The leuco form of dyes which have amino or substituted amino groups within the dye structure and which are characterized as cationic dyes employ an amine salt-forming mineral acid, organic acid or an acid from a compound supplying acid, e.g., in amounts of 0.33 to 1.0 mole per mole of amino nitrogen in the dye, preferably about 0.5 to 0.9 mole per mole of amino nitrogen. Suitable acids of this type are taught in U.S. Pat. No. 3,445,234, column 13, lines 14 to 41.

Polymeric binders may also be present in the photosensitive system to thicken the compositions or adhere them to substrates. A binder can also serve as a matrix for the composition making the mixture more readily cast, extruded or otherwise formed into layers. Examples of binders are disclosed in U.S. Pat. No. 3,445,234, column 14, lines 57 to 68. The amount of binder present varies from about 0.5 part to about 200 parts by weight per part of the leuco dye/photooxidant compound. With certain polymers, it may be desirable to add a plasticizer to give flexibility to the film or coating. Examples of plasticizers are disclosed in U.S. Pat. No. 3,445,234, column 14, line 70 to column 15, line 8.

Standard substrates can be used to support the dry layer of the photosensitive system, e.g., those used in the graphic arts and decorative applications. These materials include paper ranging from tissue paper to heavy cardboard; films of plastics and polymeric materials such as cellulose acetate, polyesters, e.g., polyethylene terephthalate, subbed or unsubbed as known in the art, and the other materials disclosed in U.S. Pat. No. 3,445,234, column 15, lines 15 to 36.

The preparation of the leuco dye/hexaarylbiimidazole photosystem systems, with or without the additives discussed above, is described in U.S. Pat. No. 3,445,234, column 15, line 39 to column 16, line 9. The leuco dye/other photooxidant photosensitive systems can be prepared in a similar manner. In use, the systems are exposed to a convenient source of ultraviolet light, in general sources which supply radiation in the region between about 2000 Å and about 4200 Å. A suitable image is formed by a beam of light or by exposure to light of a selected area behind a negative, a stencil or other relatively opaque pattern. The light sources and image-forming sources are disclosed in U.S. Pat. No. 3,445,234, column 16, lines 11 to 72.

BEST MODE FOR CARRYING OUT THE INVENTION

The best mode for the embodiment wherein the cyclic phenylhydrazide is present in the photosensitive composition is illustrated in Example 5. The best mode for the embodiment wherein the leuco dye/hexaarylbiimidazole containing layer is dipped into a solution of cyclic phenylhydrazide is illustrated in Example 6.

INDUSTRIAL APPLICABILITY

The photosensitive system is useful in printing applications such as light-actuated color image formation and provides a dry, nonsilver photosensitive system capable of imaging in various colors and shades on various substrates, including films, fabrics, paper and similar fibrous sheet material. Subsequent to exposure the colored image can be rendered permanent by contacting with a solution containing a cyclic phenylhydrazide as defined above.

The photoimaging method is broadly useful in optical printing and wherever it is desirable to capture image patterns as in photography, decoration, or recording continuous tone or alphanumeric information. The applied radiation may be passed through a variety of modulating devices, e.g., lenses, negatives, stencils, transparencies, etc. The imaging method is especially useful, in that it yields an image record immediately upon impingement of the radiation without subsequent processing, so as to permit the user to establish the effect of the exposure method instantly. This is of particular advantage in areas where the speed of access is of economic value, as for example, in prepress proofing, e.g., proofing of separation negatives as are utilized to judge the quality of subsequent color printing operations. Herein, the instant access of the proof permits rapid evaluation of the single color and composite made from magenta, cyan, yellow and black films without delays attendant in washoff, toning, or wet-processing. The materials of this invention can be handled in strong viewing light, e.g., up to about 6890 meter-candles of 5000° K. light as measured with a Sekonic® studio delux light meter Model L-398 for up to 15 minutes or more, or an integrated exposure of about 1700 meter-candle-hours, without background color development. Normally, this is a far greater time than is required to establish the quality of the negative which is being proofed. The inhibitory effect on color formation resulting from the presence of the cyclic phenylhydrazide compounds also reduces adverse effects from fogging, or background color development during handling. By suitable formulation, it is possible to design coatings which can be imaged, viewed and which permit image add-on as a result of a second or third exposure. With suitable negatives, the image patterns that are formed are capable of excellent continuous tone, resulting in high transparency quality for overhead projections, using commercial instruments. Additionally, the inclusion of a cyclic phenylhydrazide improves the image quality in that the presence of these materials reduces the halation effects resulting from light scattering. Another advantage of the inclusion of cyclic phenyldrazides in the coatings is that they reduce background color buildup of the coatings prior to imaging, as may result on extended storage of such films under adverse temperature conditions. Furthermore, coating lacquers containing these compounds exhibit less tendency to form color during storage at ambient temperatures than do those which lack such compounds.

EXAMPLES

The following examples illustrate the invention wherein the percentages are by weight.

EXAMPLES 1 TO 4

PREPARATION OF THE COATING SOLUTIONS

The coating solutions are prepared by mixing the components under yellow light conditions. The order of addition is generally as follows:

(1) solvent(s)
(2) plasticizer(s)
(3) acid
(4) cyclic phenylhydrazide
(5) photooxidant(s)
(6) leuco dye(s)
(7) surfactant(s) or antiblocking agent(s)
(8) binder(s).

However, it is understood by those skilled in the art that certain combinations of ingredients may require some change in the above order due to varying solubility characteristics of the various members of a stipulated type of component.

Total solids of the coating solutions range from 9 to 27%. The solutions are coated with a 025 wire wound rod onto sheets of polyethylene terephthalate film, 0.076 mm in thickness, are dried with hot air, and are evaluated in the following manner: The films are exposed through suitable separation photographic negatives in intimate contact through a bank of blacklight blue fluorescent lamps, with irradiance of 6 mw/cm$^2$ for periods from 60 to 90 seconds. A colored image is formed through the areas of transmission of the negative. The coatings of the examples indicated below will give images of the indicated color with maximum image densities as recorded over the exposure period described above. When the several examples are composited in registry, a multicolor overlay film with excellent image quality and faithful color rendition is obtained. This film composite may be viewed by reflected or transmitted light for periods up to 15 minutes without background color buildup. If permanence, or exposure to light for longer periods is desired, the separate films are passed through a solution containing a phenylhydrazide of the type as described in Examples 1 to 4.

| Example | Dry Coating (g/sq m) wt. | Color Formed | Image Density (Reflectance*) |
|---|---|---|---|
| 1 | 22.47 | yellow | 1.36 |
| 2 | 6.99 | magenta | 1.14 |
| 3 | 23.98 | cyan | 1.33 |
| 4 | 32.26 | black | 2.0 |

*Reflectance density measured over white background.

EXAMPLE 1 SOLUTION

| COMPONENT | % of TOTAL SOLUTES | % of SOLUTION |
|---|---|---|
| cellulose acetate butyrate | | |

-continued

| COMPONENT | % of TOTAL SOLUTES | % of SOLUTION |
|---|---|---|
| (~27% butyryl content ~1 hydroxyl/2 anhydroglucose units, and viscosity 7.5–15 poises by ASTM D-817-65-D) (binder) | 46.20 | 11.0 |
| 2,2'-bis-(o-chlorophenyl)-4,-4',5,5'-tetrakis-(m-methoxy-phenyl)-biimidazole (initiator) | 7.21 | 1.71 |
| 2,2'-bis-(o-chlorophenyl)-4,-4',5,5'-tetraphenylbiimidazole (initiator) | 5.94 | 1.41 |
| $CF_3-(CF_2-CF_2)_{17}CH_2CH_2-O-\overset{O}{\overset{\|}{C}}-(CH_2)_{16}-CH_3$ (surfactant) | 0.12 | 0.03 |
| (4-[N-ethyl-N{2-hydroxy-3-phenoxy-propyl}amino]-2-methylbenzylmalononitrile) carbanilate ester (leuco yellow dye) | 6.69 | 1.60 |
| p-toluenesulfonic acid | 2.64 | 0.63 |
| nonylphenoxyoly(ethyleneoxy)-ethanol (plasticizer) | 30.80 | 7.32 |
| 1-phenylpyrazolidine-3-one | 0.04 | 0.10 |
| Total solutes | | 23.80 |
| isopropyl alcohol | | 7.80 |
| methylene chloride | | 68.40 |

EXAMPLE 2 SOLUTION

| COMPONENT | % of TOTAL SOLUTES | % of SOLUTION |
|---|---|---|
| cellulose acetate butyrate of Example 1 (binder) | 56.26 | 7.83 |
| 2,2'-bis-(o-chlorophenyl)-4,4',5,5'-tetrakis-(m-methoxyphenyl)-biimidazole (initiator) | 5.47 | 0.76 |
| 2,2'-bis-(o-chlorophenyl)-4,4',5,5'-tetraphenyl-biimidazole (initiator) | 4.63 | 0.64 |
| $CF_3(CF_2CF_2)_{17}CH_2CH_2-O-\overset{O}{\overset{\|}{C}}-(CH_2)_{16}-CH_3$ (surfactant) | 0.20 | 0.03 |
| p-dibutylaminophenyltricyano-ethane (leuco magenta dye) | 1.22 | 0.17 |
| N-ethyl-p-toluenesulfonamide (plasticizer) | 15.56 | 2.16 |
| p-toluenesulfonic acid | 0.91 | 0.12 |
| nonylphenoxypoly(ethyleneoxy)-ethanol (plasticizer/solvent) | 15.56 | 2.16 |
| triethanolamine triacetate (hydrogen donor) | 0.03 | 0.01 |
| 1-phenylpyrazolidine-3-one | 0.16 | 0.02 |
| Total solutes | | 13.90 |
| isopropyl alcohol | | 7.80 |
| methylen chloride | | 78.30 |

EXAMPLE 3 SOLUTION

A coating solution of a cyan photosensitive imaging composition is prepared from the following components:

| COMPONENT | % of TOTAL SOLUTES | % of SOLUTION |
|---|---|---|
| cellulose acetate butyrate of Example 1 (binder) | 71.71 | 13.16 |
| 2,2'-bis-(o-chlorophenyl)-4,4'-5,5'-tetrakis(m-methoxyphenyl)-biimidazole (initiator) | 0.65 | 0.12 |
| 2,2'-bis(o-chlorophenyl)-4,4',5,5'-tetraphenylbiimidazole (initiator) | 0.55 | 0.10 |
| $CF_3(CF_2CF_2)_{17}CH_2CH_2-O-\overset{O}{\overset{\|}{C}}-(CH_2)_{16}-CH_3$ (surfactant) | 0.35 | 0.06 |
| tris-(2-methyl-4-diethylamino-phenyl)methane (leuco cyan dye) | 0.83 | 0.15 |
| p-toluenesulfonic acid | 0.87 | 0.16 |
| nonylphenoxypoly(ethyleneoxy)-ethanol (plasticizer) | 25.02 | 4.59 |
| 1-phenylpyrazolidine-3-one | 0.02 | 0.01 |
| Total solutes | | 18.35 |
| isopropyl alcohol | | 8.17 |
| methylene chloride | | 73.48 |

EXAMPLE 4 SOLUTION

A coating solution of a black photosensitive imaging composition is prepared from the following components:

| COMPONENT | % of TOTAL SOLUTES | % of SOLUTION |
|---|---|---|
| cellulose acetate butyrate of Example 1 (binder) | 61.80 | 16.69 |
| 2,2'-bis(o-chlorophenoxy)-4,4',5,5'-tetrakis(m-methoxyphenyl)-biimidazole (initiator) | 5.99 | 1.62 |
| 2,2'-bis(o-chlorophenyl)-4,4',5,5'-tetraphenyl-biimidazole (initiator) | 5.60 | 1.51 |
| $CH_3(CF_2-CF_2)_{17}CH_2CH_2-O-\overset{O}{\overset{\|}{C}}-(CH_2)_{16}-CH_3$ (surfactant) | 0.28 | 0.07 |
| p-dibutylaminophenyltricyano-ethane (leuco magenta dye) | 0.34 | 0.09 |
| bis-(2-methyl-4-diethylamino-phenyl)-(4-diethylaminophenyl) methane (leuco green dye) | 1.42 | 0.38 |
| n-ethyl-p-toluenesulfonamide (solid plasticizer) | 11.43 | 3.09 |
| nonylphenoxypolyl(ethyleneoxy) ethanol (plasticizer) | 11.43 | 3.09 |
| p-toluenesulfonic acid | 1.48 | 0.40 |
| 1-phenylpyrazolidine-3-one | 0.23 | 0.06 |
| Total solutes | | 27.00 |
| methylene chloride | | 66.00 |
| isopropyl alcohol | | 7.00 |

EXAMPLE 5

A coating solution of an orange photosensitive imaging composition is prepared from the following ingredients:

| COMPONENT | % of TOTAL SOLUTES | % of SOLUTION |
|---|---|---|
| cellulose acetate butyrate | | |

-continued

| COMPONENT | % of TOTAL SOLUTES | % of SOLUTION |
|---|---|---|
| (~27% butyryl content, ~1 hydroxyl/2 anhydroglucose units; viscosity 56–131 poises by ASTM D-817-65-D) (binder) | 60.80 | 8.63 |
| 2,2'-bis-(o-chlorophenoxy)-4,4'5,5'-tetrakis-(m-methoxy-phenyl) biimidazole (initiator) | 14.00 | 1.99 |
| 2-methyl-3-[(1',3',3'-trimethyl-indolin-2-yl)-vinyl-]-indole (leuco orange dye) | 1.20 | 0.17 |
| p-dibutylaminophenyltricyano-ethane (leuco magenta dye) | 0.90 | 0.13 |
| p-toluenesulfonic acid | 1.50 | 0.22 |
| nonylphenoxypoly(ethyleneoxy)-ethanol (plasticizer) | 21.30 | 3.02 |
| 1-phenylpyrazolidine-3-one | 0.30 | 0.04 |
| Total solutes | | 14.20 |
| isopropyl alcohol | 8.60 | |
| methylene chloride | | 77.20 |

The above solution is applied to a 4-mil (0.10 mm) thick and 7-mil (~0.18 mm) polyethylene terephthalate film support having a subbing layer and an antistatic polysilic acid back coating. Conventional laboratory coating method is employed in coating the thin support, while the thicker support is coated employing an industrial coating unit.

The dry layers are exposed on a 2 KW Berkey ASCOR ® exposure unit, 30×40 Vacuum Printer, Model #1601-40 fitted with a 2 KW photopolymer bulb No. 1406-02 for two to four minutes. The exposed image has a density of 1.1 to the green region of the spectrum and 1.5 to the blue region of the spectrum.

A control element containing no 1-phenylpyrazolidine-3-one exhibits continuing color build-up during storage in the dark whereas the formulation containing 1-phenylpyrazolidine-3-one exhibits good color stability in the dark and improved room light stability. It takes $10^2$–$10^3$ times as long in the dark and 5 to 10 times as long in room light to produce identical color intensity in the unexposed element of the invention as it does with the control element.

EXAMPLE 6

A fix solution is prepared from the following components:

2350.0 g water
1150.0 g propanol-2
35.0 g sodium sulfite
35.0 g acetic acid
70.0 g 1-phenylpyrazolidine-3-one.

Film samples prepared as described in Examples 1 to 4 are immersed in the fix solution for periods of from 20 to 60 seconds at temperatures of from 25° to 40° C. The films were rinsed with water subsequent to the treatment. The treated films are stable to ambient light for periods up to at least one month. The fix solution can be used in a conventional automatic photographic processor, to permit automated "fixing". The fix solutions are stable for at least one week.

EXAMPLE 7

A stock solution is prepared from the following components:

235.0 g water
115.0 g methanol
3.5 g sodium sulfite
3.5 g acetic acid

To 15 g portions of the above, is added 0.3 g quantities of the following cyclic phenylhydrazides:

(a) 1-phenyl-4,4-dimethyl pyrazolidine-3-one,
(b) 1-phenyl-4-methyl-4-hydroxy methyl-pyrazolidine-3-one,
(c) 1-phenyl-4-methylpyrazolidine-3-one.

Partially imaged cyan-forming films, prepared from 257.0 g methylene chloride, 28.0 propanol-2, 46.0 g cellulose acetate butyrate of Example 1, 0.83 g 2,2'-bis-(o-chlorophenyl)4,4',5,5'-tetrakis(m-methoxyphenyl)-bimidazole, 0.71 g 2,2'-bis(o-chlorophenyl)tetraphenyl 4,4',5,5'-biimidazole, 0.02 g telomer B stearate, 1.07 g tris-(p-diethylamino-o-tolyl)methane, 1.12 g p-toluenesulfonic acid, and 16 g o-phenyl phenol ethylene oxide adduct are partially immersed in the sample fix solutions at room temperature for 30 seconds. The immersed area of each film did not develop background color during a 15 minute exposure to about 1700 meter-candle-hours of fluorescent light. A film strip, similarly treated in the stock solution, lacking a cyclic phenylhydrazide build up background color.

Two cyclic phenylhydrazides, listed below, are added in 0.3 g quantities to the stock solution and the mixture is warmed, whereupon a partial solution of the solids results. Films, as described above, are immersed in the warm fix solutions (ca. 50° C.) for about 1 minute. The result of subsequent exposure to about 3400 meter-candle-hours of light during 30 minutes indicates that these compounds serve to deactivate the coating, as no background color forms:

(d) 3-methyl-1-(p-sulfophenyl)-2-pyrazolidine-5-one,
(e) 3-methyl-1-phenyl-2-pyrazolidine-5-one.

EXAMPLE 8

A coating lacquer is prepared from the following components:

| COMPONENT | AMOUNT (g) |
|---|---|
| methylene chloride | 257.0 |
| propanol-2 | 28.00 |
| o-phenyl phenol ethylene oxide adduct | 16.00 |
| 2,2'-bis(o-chlorophenyl)-4,4',-5,5'-tetrakis-(m-methoxyphenyl)-biimidazole | 0.83 |
| bis(o-chlorophenyl)tetraphenyl-biimidazole | 0.71 |
| p-toluenesulfonic acid | 1.12 |
| tris(p-diethylamino-o-tolyl) methane | 1.07 |
| telomer B stearate | 0.02 |

To 70 g of the coating lacquer is added:

(a) 0.023 g 1-phenyl-4-methylpyrazolidine-3-one,
(b) 0.014 g 1-phenyl-4,4-dimethylpyrazolidine-3-one,
(c) 0.019 g 1-phenyl-4-methyl-4-hydroxymethyl pyrazolidine-3-one Polyethylene terephthalate film samples are coated with the original lacquer and with lacquers containing the additives (a), (b) and (c), with a 025 wire wound bar. The samples are imaged through a lithographic negative for 90 seconds in a printer equipped with BLB lamps, to give essentially identical image densities in the exposed areas.

The imaged films are then exposed to about 1100 meter-candle-hours of coolwhite fluoroscent light during 10 minutes. Samples (a), (b) and (c) did not build up any background color in the unimaged areas, whereas the sample from the original lacquer built-up background.

EXAMPLE 9

Coating compositions containing the constituents set forth below are prepared and coated with a 025 coating bar on 3-mil (0.76 mm) thick polyethylene terephthalate film. Each film is tested by exposing to ultraviolet radiation through a negative for 90 seconds in a printer equipped with blacklight blue fluorescent lamps with irradiance of 6 mw/cm$^2$. The heating is at 100° C. for 16 hours.

| Sample Component | 1 | 2 | 3 | 4 | 5 | 6 | 7 | 8 | 9 | 10 | 11 | 12 |
|---|---|---|---|---|---|---|---|---|---|---|---|---|
| | Weight (g) | | | | | | | | | | | |
| 1. acetone | 100 | 100 | 17.3 | 17.3 | 13.3 | 13.3 | 15.3 | 15.3 | 13.3 | 13.3 | 13.3 | 13.3 |
| 2. propanol-2 | 21.5 | 21.5 | 3.7 | 3.7 | 2.9 | 2.9 | 3.3 | 3.3 | 2.9 | 2.9 | 2.9 | 2.9 |
| 3. nonylphenoxy-poly(ethyleneoxy) ethanol | 6.5 | 6.5 | 1.1 | 1.1 | 0.9 | 0.9 | 1.0 | 1.0 | 0.9 | 0.9 | 0.9 | 0.9 |
| 4. cellulose acetate butyrate described in Example 1. | 21.5 | 21.5 | 3.7 | 3.7 | 2.9 | 2.9 | 3.3 | 3.3 | 2.9 | 2.9 | 2.9 | 2.9 |
| 5. p-toluene sulfonic acid | 0.21 | 0.21 | 0.04 | 0.04 | 0.03 | 0.03 | 0.035 | 0.035 | 0.03 | 0.03 | 0.03 | 0.03 |
| 6. 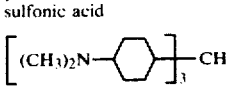 | 0.43 | 0.43 | 0.08 | 0.08 | 0.06 | 0.06 | 0.07 | 0.07 | 0.06 | 0.06 | 0.06 | 0.06 |
| 7. benzophenone | — | — | 0.04 | 0.04 | — | — | 0.2 | 0.2 | — | — | — | — |
| 8. ethyl Michler's Ketone | — | — | — | — | 0.2 | 0.2 | 0.1 | 0.1 | — | — | — | — |
| 9. t-butyl-anthraquinone | — | — | — | — | — | — | — | — | 0.4 | 0.4 | — | — |
| 10. thioxanthen-9-one | — | — | — | — | — | — | — | — | — | — | 0.4 | 0.4 |
| 11. 1-phenylpyrazolidine-3-one | — | 0.5 | — | 0.09 | — | 0.07 | — | 0.08 | — | 0.07 | — | 0.07 |

After removal from the oven the films exhibited the following effects:

| Sample | Effect UV Exposure | Heating |
|---|---|---|
| 1 | O | V |
| 2 | O | O |
| 3 | V | V |
| 4 | FV | O |
| 5 | BG | V |
| 6 | O | O |
| 7 | BG | V |
| 8 | O | O |
| 9 | V | V |
| 10 | FV | O |
| 11 | V | FV |
| 12 | FV | O |

O = no color formation
V = violet color
BG = bluegray color
FV = faint violet color The results show that 1-phenylpyrazolidine-3-one is an effective thermal stabilizing agent, i.e., samples containing it did not develop background color on extended heating periods, whereas the control samples lacking 1-phenylpyrazolidine-3-one developed color.

EXAMPLE 10

This example illustrates solution stability. A magenta coating composition as described in Example 2 is stored at ambient temperature for one week without color development. An identical composition but without the 1-phenylpyrazolidine-3-one developed a red color after standing at ambient temperature for 3 days.

EXAMPLE 11

A coating composition is prepared from the following components:

| COMPONENT | AMOUNT (g) |
|---|---|
| methylene | 243.0 |
| propanol-2 | 30 |
| cellulose acetate butyrate described in Example 1 | 35.0 |
| ortho-phenyl phenol ethylene oxide adduct | 5.70 |
| p-toluenesulfonic acid | 4.70 |
| bis-p-(diethylamino-o-tolyl)-3,4-dimethoxyphenylmethane | 3.94 |
| 2,2'-bis(o-chlorophenyl)-4,4',5,5'-tetraphenylbiimidazole | 13.7 |

To an aliquot of this mixture is added 0.02 mole percent of 1-phenyl-pyrazolidine-3-one based on the concentration of the photoinitiator.

Both solutions are coated with a 020 bar on bleached sulfite bond paper, and after drying, are imaged through a screened negative in a contact printer as described in Example 9. After 30 seconds, both formed intense images, but the dot pattern of the coating made with the 1-phenyl-pyrazolidine-3-one-containing composition is sharper, and remains so for several days. This example shows that improved dot quality is achieved with a composition containing 1-phenyl-pyrazolidine-3-one.

EXAMPLE 12

A coating composition is prepared from the following components:

| COMPONENTS | AMOUNT (g) |
|---|---|
| cellulose acetate butyrate of Example 1 | 92.00 |
| 2,2'-bis(o-chlorophenyl)-4,4',5,5'-tetraphenylbiimidazole (initiator) | 1.42 |
| 2,2'-bis(o-chlorophenyl)-4,4',5,5'- | |

-continued

| COMPONENTS | AMOUNT (g) |
|---|---|
| tetrakis-(m-methoxyphenyl)-biimidazole (initiator) | 1.66 |
| $CF_3-(CF_2-CF_2)_{10}CH_2CH_2-O-\overset{O}{\overset{\|\|}{C}}-(CH_2)_{16}-CH_3$ (surfactant) | 0.44 |
| tris-(p-diethylamino-o-tolyl)methane (leuco cyan dye) | 2.14 |
| p-toluenesulfonic acid (hydrogen acid) | 2.24 |
| o-phenyl phenol ethylene oxide adduct (plasticizer) | 32.0 |
| methylene chloride (solvent) | 514.0 |
| isopropanol (solvent) | 56.0 |

To separate 50 g aliquots of this solution are added from 0.015 to 0.025 g ($10^{-4}$ mol in each case) of the respective stabilizer compounds listed below. The solutions are then coated and dried as described in Examples 1 to 4 except that a 020 wire wound rod is used.

The dry films are tested for imaged color formation as described in Examples 1 to 4 and background color formation as described in Example 7, except that background color formation is observed at 10, 45 and 60 minutes exposure times. Color intensities are ranked on the following qualitative scale:

No = no color formation
VW = very weak color formation
W = weak
W-M = weak to moderate color formation
M = moderate color formation
M-S = moderate to strong color formation
S = strong color formation
VS = very strong color formation All test compounds show inhibition of background color formation with some image color intensity loss. Inhibition efficiency decreases at longer exposure times, i.e., 45 minutes and 60 minutes are noted. However, at the 10 minute time typical of, or in excess of the time required for observation in "instant proofing" work, the results are classed as good-to-excellant. Results are shown in the table below for the test compounds coded as follows:

| Designation | Test Compound |
|---|---|
| A | 1-phenylpyrazolidine-3-one |
| B | 1-phenyl-4-methylpyrazolidine-3-one |
| C | 1-phenyl-4,4'-dimethylpyrazolidine-3-one |
| D | 1-phenyl-4-methyl-4-hydroxymethyl-pyrazolidine-3-one |
| E | 1-phenyl-3-methyl-2-pyrazoline-5-one |
| F | 1-sulfophenyl-3-methyl-2-pyrazoline-5-one |
| Control | None |

TABLE

| Test Compounds | Color Formation | |
|---|---|---|
| | Imaged | Background |
| A | M | No* |
| B | M-S | No |
| C | M-S | VW |
| D | M-S | W |
| E | M-S | W |
| F | S | W |
| Control | VS | W-M |
| A | M | W** |
| B | M-S | W |
| C | M-S | W |
| D | M-S | W |
| E | M-S | W |

TABLE -continued

| Test Compounds | Color Formation | |
|---|---|---|
| | Imaged | Background |
| F | M-S | W |
| Control | VS | M |
| A | M | W*** |
| B | M-S | W |
| C | M-S | W |
| D | M-S | W-M |
| E | M-S | W-M |
| F | M-S | W-M |
| Control | VS | M |

*background color formation at 10 minutes
**background color formation at 45 minutes
***background color formation at 60 minutes

We claim:

1. A photosensitive system comprising in intimate admixture (1) at least one dye in the leuco form having one to two removable hydrogens, the removal of which forms a differently colored compound; with the proviso that when the leuco form has only one removable hydrogen and the resultant dye is cationic, there is also present a mineral acid, organic acid or acid-supplying compound which forms a salt with the leuco form of the dye, and (2) at least one photooxidant compound taken from the group of 2,4,5-triarylbiimidazolyl dimer consisting of two lophine radicals bound together by a single covalent bond, benzophenone, a para-aminophenyl ketone, a polynuclear quinone, a thioxanthenone, and mixtures thereof, the improvement being that in the presence of said admixture is at least one cyclic phenylhydrazide compound of the formula:

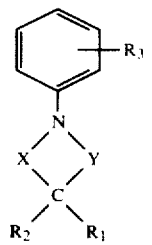

wherein X may be either $H_2C<$ or $O=C<$ with the proviso that when X is $H_2C<$, Y is

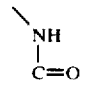

and when X is $O=C<$, Y is

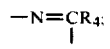

$R_1$ and $R_2$ are the same or different and are hydrogen atoms, alkyl of 1 to 4 carbon atoms, hydroxyalkyl of 1 to 4 carbon atoms; $R_3$ is hydrogen, alkyl of 1 to 4 carbon atoms in the ortho, meta or para positions, alkoxy of 1 to 4 carbon atoms in the ortho, meta or para positions, chloro, fluoro or bromo in the meta or para positions, sulfo in the para position, substituted alkyl, aralkoxy, and aryloxy; and $R_4$ is hydrogen and alkyl of 1 to 4 carbon atoms.

2. A photosensitive system according to claim 1 wherein in the presence of the admixture is up to 10 mole percent of the cyclic phenylhydrazide based on the photooxidant compound.

3. A photosensitive system according to claim 2 wherein the photooxidant is a 2,4,5-triarylbiimidazolyl dimer consisting of two lophone radicals bound together by a single covalent bond.

4. A photosensitive system according to claim 2 wherein the photooxidant is the combination of benzophenone and a para-aminophenyl ketone.

5. A photosensitive system according to claim 2 wherein the photooxidant is a polynuclear quinone.

6. A photosensitive system according to claim 2 wherein the photooxidant is a thioxanthenone.

7. A photosensitive system according to claim 2 wherein the cyclic phenylhydrazide is 1-phenyl-pyrazolidine-3-one.

8. A photosensitive system according to claim 2 wherein the cyclic phenylhydrazide is 1-phenyl-4-methyl-pyrazolidine-3-one.

9. A photosensitive system according to claim 2 wherein the cyclic phenylhydrazide is 1-phenyl-4,4-dimethyl-pyrazolidine-3-one.

10. A photosensitive system according to claim 2 wherein the cyclic phenylhydrazide is 3-methyl-1-(p-sulfophenyl)-2-pyrazoline-5-one.

11. A photosensitive system according to claim 2 wherein the cyclic phenylhydrazide is 3-methyl-1-phenyl-2-pyrazoline-5-one.

12. A photosensitive system according to claim 3 wherein the leuco dye is an aminotriarylmethane.

13. A photosensitive system according to claim 12 wherein the 2,4,5-triarylbiimidazolyl dimer is bis(o-chlorophenyl)tetraphenylbiimidazole.

14. A photosensitive system according to claim 12 wherein the 2,4,5-triarylbiimidazolyl dimer is 2,2'-bis(o-chlorophenyl)4,4',5,5'tetrakis-(m-methoxyphenyl)-biimidazole.

15. A photosensitive system according to claim 13 or claim 14 wherein the cyclic phenylhydrazide is 1-phenyl-pyrazolidine-3-one.

16. A photosensitive system according to claim 4 wherein the leuco dye is an aminotriarylmethane.

17. A photosensitive system according to claim 16 wherein the 2,4,5-triarylbiimidazolyl dimer is bis(o-chlorophenyl)tetraphenylbiimidazole.

18. A photosensitive system according to claim 16 wherein the 2,4,5-triarylbiimidazolyl dimer is 2,2'-bis(o-chlorophenyl)4,4',5,5'-tetrakis-(m-methoxyphenyl)-biimidazole.

19. A photosensitive system according to claim 17 or claim 18 wherein the cyclic phenylhydrozide is 1-phenyl-pyrazolidine-3-one.

* * * * *